US005526903A

United States Patent [19]

Shu et al.

[11] Patent Number: 5,526,903

[45] Date of Patent: Jun. 18, 1996

[54] LOW PROFILE, HIGH LOAD VERTICAL ROLLING POSITIONING STAGE

[75] Inventors: Deming Shu, Darien; Juan Barraza, Aurora, both of Ill.

[73] Assignee: The University of Chicago, Chicago, Ill.

[21] Appl. No.: 297,979

[22] Filed: Aug. 30, 1994

[51] Int. Cl.[6] ..... B66B 9/02

[52] U.S. Cl. ..... 187/271; 187/267; 187/268

[58] Field of Search ..... 187/268, 267, 187/271

[56] References Cited

U.S. PATENT DOCUMENTS

| | | | |
|---|---|---|---|
| 2,587,757 | 3/1952 | Panter | 187/268 |
| 2,627,321 | 2/1953 | Brubaker | 187/268 |
| 3,468,401 | 9/1969 | Letz | 187/268 |
| 4,768,621 | 9/1988 | Kunii | 187/268 |

FOREIGN PATENT DOCUMENTS

| | | | |
|---|---|---|---|
| 2597461 | 10/1987 | France | 187/268 X |
| 8200453 | 2/1982 | WIPO | 187/268 X |

*Primary Examiner*—William E. Terrell

*Assistant Examiner*—Dean A. Reichard

*Attorney, Agent, or Firm*—Mason, Kolehmainen Rathburn & Wyss

[57] ABSTRACT

A stage or support platform assembly for use in a synchrotron accurately positions equipment to be used in the beam line of the synchrotron. The support platform assembly includes an outer housing in which is disposed a lifting mechanism having a lifting platform or stage at its upper extremity on which the equipment is mounted. A worm gear assembly is located in the housing and is adapted to raise and lower a lifting shaft that is fixed to the lifting platform by an anti-binding connection. The lifting platform is moved vertically as the lifting shaft is moved vertically. The anti-binding connection prevents the shaft from rotating with respect to the platform, but does permit slight canting of the shaft with respect to the lifting platform so as to eliminate binding and wear due to possible tolerance mismatches. In order to ensure that the lifting mechanism does not move in a horizontal direction as it is moved vertically, at least three linear roller bearing assemblies are arranged around the outer-periphery of the lifting mechanism. One of the linear roller bearing assemblies can be adjusted so that the roller bearings apply a loading force against the lifting mechanism. Alternatively, a cam mechanism can be used to provide such a loading force.

17 Claims, 5 Drawing Sheets

FIG. 8C
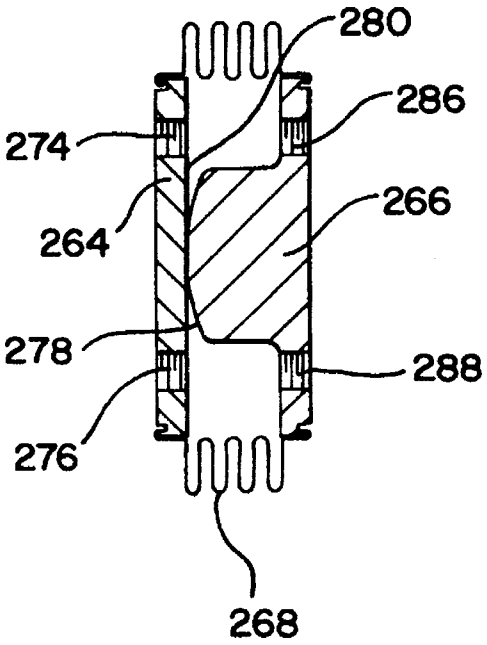
FIG. 8A
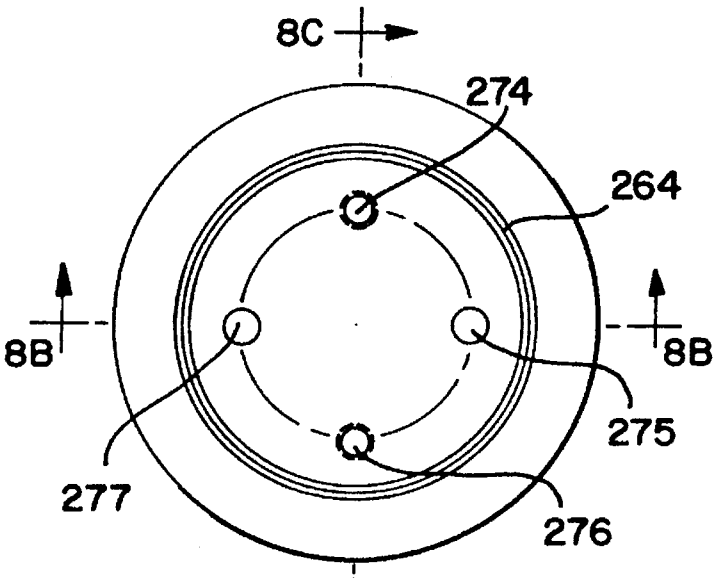
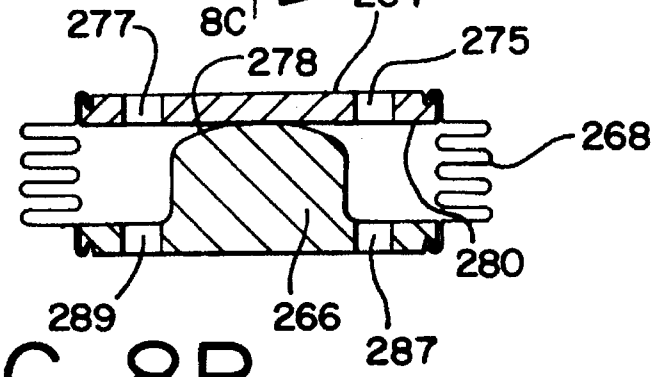
FIG. 8B

LOW PROFILE, HIGH LOAD VERTICAL ROLLING POSITIONING STAGE

The United States Government has rights in this invention pursuant to Contract No. W-31-109-ENG-38 between the United States Government and Argonne National Laboratory.

BACKGROUND OF THE INVENTION

1. Field of the Invention

This invention relates to a vertically positionable stage or platform on which relatively heavy loads can be supported, and more particularly, to a new and improved stage or platform that is to be vertically positioned within a synchrotron and that has a low profile, compact design so as to be disposed in a limited space, but nevertheless is capable of accurately positioning heavy loads supported on the stage or platform in the beam line of the synchrotron.

2. Background of the Invention

High energy synchrotron radiation sources are used for research in the fields of endeavor such as the fields of material science, chemistry, physics, medical and biological imaging and geophysics. In a seven (7) GeV Advanced Photon Source (APS), high brilliance and intense synchrotron radiation developed by the APS in a front end or ring side of the radiation beam is transmitted along a beam line that may be 70 meters in length. A number of different front end components need to be installed inside the front end along the beam line. These components include such devices as photon beam position monitors, fixed masks, photon and safety shutters, filters, windows and differential pumps. In some instances, the devices can weigh as much as 500 kg. Many of these devices need to be supported on a platform or support stage that is capable of accurately positioning the device within the front end of the beam line. The devices need to be accurately positioned because the system design permits only small tolerance errors in order that the photon beam passing through these devices are not adversely affected. The supported devices additionally need to be immune from any vibrations that may be introduced due to rapid shuttering functions.

While the support stage needs to be capable of supporting significant loads and accurately positioning the loads in the front end of the beam line, the floor space provided for the front end components is only approximately 1 m wide and the access to the space is typically through a 1.422 m door. As can be appreciated, these space constraints limit the size of the support structures. In fact, the supports ideally should not be more than about 485 mm in width and about 1.2 m in overall height Accordingly, it is an object of the present invention to provide a new and improved stage or platform on which relatively heavy loads are to be supported in a synchrotron.

It is another object of the present invention to provide a new and improved stage or platform for a synchrotron that has low profile, but nevertheless can very accurately position relatively heavy devices in the front end of a beam line in the synchrotron.

It is yet another object of the present invention to provide a new and improved stage or platform for a synchrotron that is immune from introduced vibrations in the front end of the synchrotron.

It is still another object of the present invention to provide a new and improved stage or platform for a synchrotron that is not adversely affected by tolerance mismatches of its components.

SUMMARY OF THE INVENTION

In accordance with these and many other objects of the present invention, the present invention is embodied in a stage or support platform assembly for use in a synchrotron in order to accurately position equipment to be used in the beam line of the synchrotron. The support platform assembly includes an outer housing in which is disposed a lifting mechanism having a lifting platform or stage at its upper extremity. A worm gear assembly is located in the housing and is adapted to raise and lower a lifting shaft that is fixed to the lifting platform by an anti-binding connection. As a result, the lifting platform is raised and lowered as the lifting shaft is moved up and down. The anti-binding connection prevents the shaft from rotating with respect to the platform, but does permit slight canting of the shaft with respect to the lifting platform so as to eliminate binding and wear due to possible tolerance mismatches. In order to ensure that the lifting mechanism does not move in a horizontal direction as it is moved vertically, at least three linear roller bearing assemblies are arranged around the outer-periphery of the lifting mechanism. One of the linear roller bearing assemblies can be adjusted to place a preload force against the roller bearings. Alternatively, a preload cam mechanism can be used to provide such a preloading force on the roller bearings.

BRIEF DESCRIPTION OF THE DRAWINGS

These and many other objects and advantages of the present invention will become readily apparent from consideration of the following detailed description of the embodiments of the invention shown in the accompanying drawings wherein:

FIG. 8A is a top view of an anti-binding connection used in the support platform assembly shown in FIG. 7;

FIG. 8B is a cross-sectional view of the anti-binding connection shown in FIG. 8A taken along line 8B–SB in FIG. 8A;

FIG. 8C is a cross-sectional view of the anti-binding connection shown in FIG. 8A taken along line 8C—8C in FIG. 8A;

DETAILED DESCRIPTION OF THE PREFERRED EMBODIMENTS

Figure 1:
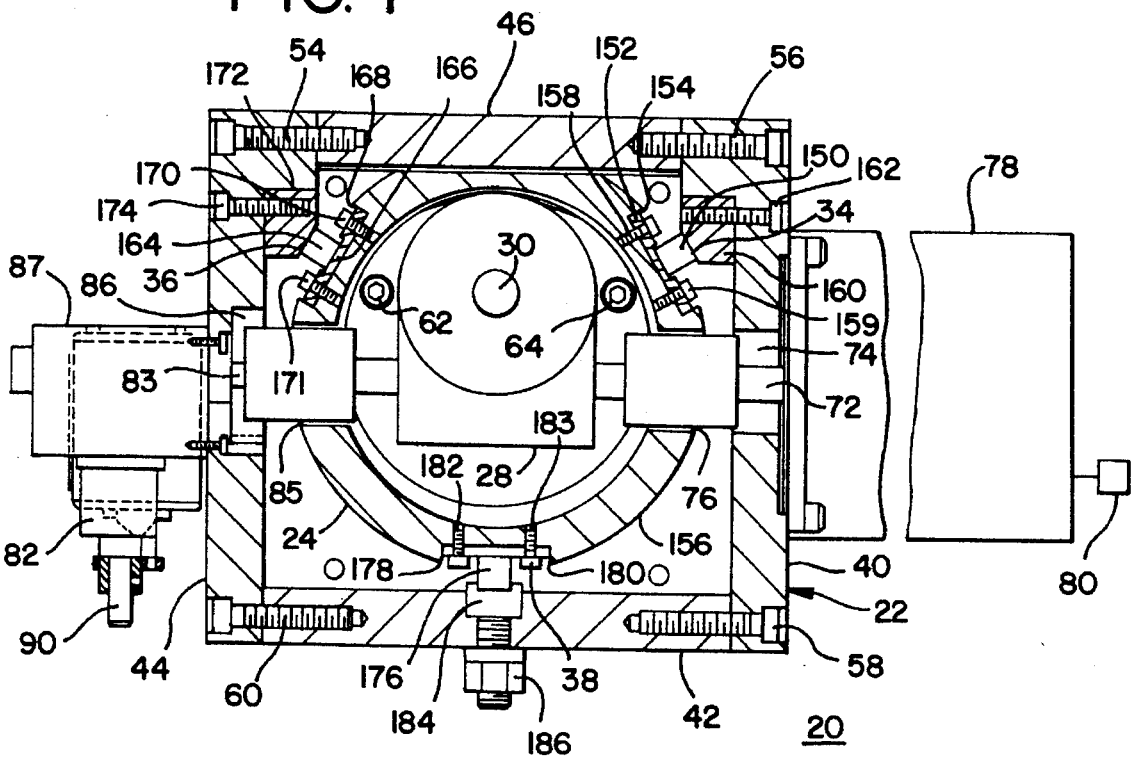
FIG. 1 is a top cross-sectional view of a support platform assembly which embodies the present invention.
Figure 2:
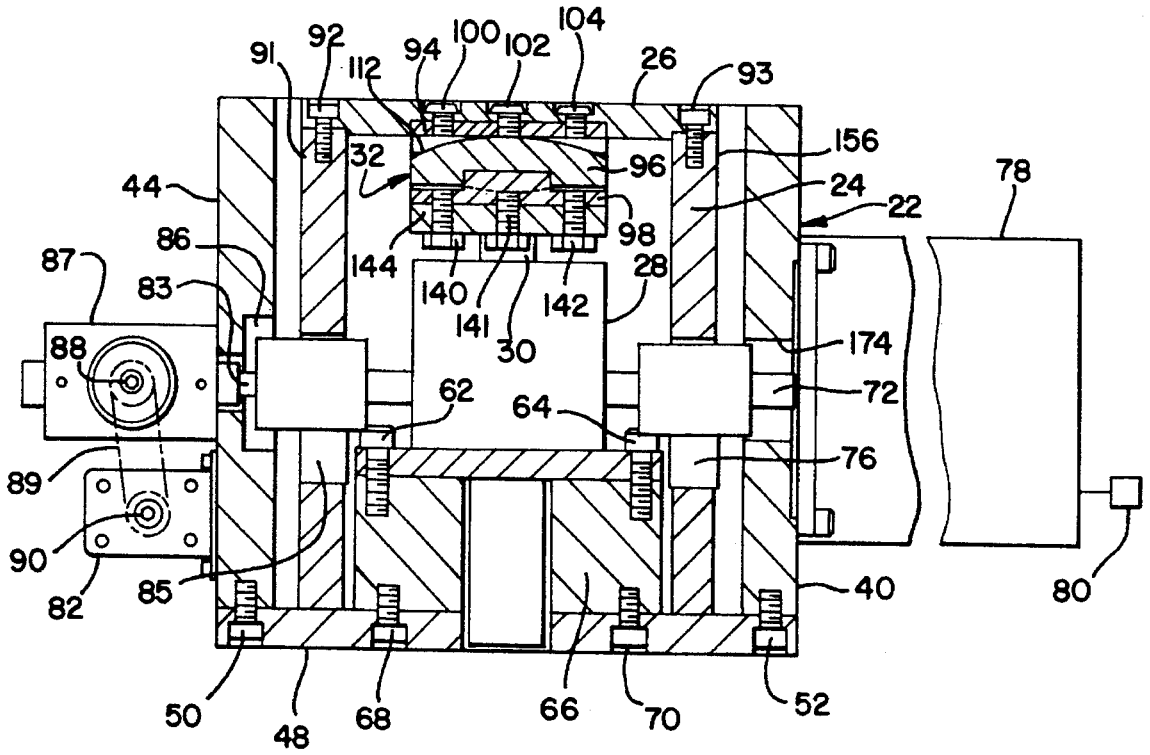
FIG. 2 is a side cross-sectional view of the support platform assembly shown in FIG. 1.

Referring now more specifically to FIGS. 1–2, therein is disclosed a support platform assembly for use in a synchrotron for accurately positioning equipment to be used in the beam line of the synchrotron, the support platform assembly being generally designated by the reference numeral 20 and embodying the present invention. The support platform assembly 20 includes an outer housing 22 in which is disposed a generally right cylindrically shaped lifting mechanism 24 having a lifting platform or stage 26 at its upper extremity. A worm gear assembly 28 located in the housing 22 raises and lowers a lifting shaft 30 that is connected to the lifting platform 26 by an anti-binding connection 32. As a result, the lifting platform 26 is raised and lowered as the lifting shaft 30 is moved up and down. The anti-binding connection 32 prevents the shaft 30 from rotating with respect to the platform 26, but does permit slight canting of the shaft 30 with respect to the lifting platform 26 to eliminate binding and wear due to possible tolerance mismatches. In order to ensure that the lifting mechanism 24 does not move in a horizontal direction as it is moved vertically, three linear roller bearing assemblies 34, 36, and 38 are arranged around the outer-periphery of the lifting mechanism 24.

The outer housing 22 is formed by vertical side walls 40, 42, 44, and 46 and a base member 48. The side walls 40, 42, 44, and 46 are secured to the base member 48 by fasteners including fasteners 50 and 52 (shown in FIG. 2) whereas the side walls 40, 42, 44, and 46 are secured by fasteners including fasteners 54, 56, 58 and 60 (shown in FIG. 1) to each other to form the housing 22. The housing 22 is adapted to house the worm gear assembly 28 with the lifting platform 26 moveable through the open top of the housing 22.

The worm gear assembly 28 is secured by fasteners 62 and 64 to a worm gear mounting block 66 that is secured to the base member 48 by fasteners including fasteners 68 and 70. As is seen in FIG. 1, the worm gear assembly 28 is positioned off-center in the housing 22 such that the worm gear assembly 28 is closer to the wall 46 than the opposite wall 42 of the housing 22. The worm gear assembly 28 is positioned in this off-center manner because of the limited amount of space that is available for the worm gear assembly 28 within the cylindrically shaped lifting mechanism 24.

The worm gear assembly 28 includes the lifting shaft 30 that is to be raised and lowered in response to the rotation of a worm gear input shaft 72. The shaft 72 extends through an opening 74 in the side wall 40 and an opening 76 in the lifting mechanism 24 from a worm gear stepper motor 78 mounted on the side wall 40 on the outside of the housing 22. When the worm gear motor 78 is energized, a nut (not shown) in the worm gear assembly 28 will rotate about a threaded end of the lifting shaft 30 to thereby cause the lifting shaft 30 to be raised or lowered depending on the direction that the nut is rotated within the worm gear assembly 28. As a result, the lifting shaft 30 is raised or lowered, but is not rotated. The amount that the lifting shaft 30 is moved in the vertical direction is dependent on the energization of the worm gear stepper motor 78 under the control of an automated control 80. In one embodiment of the support platform assembly 20, the platform assembly 20 is capable of positioning a 4000N load and the lifting shaft 30 is capable of traveling at least 25 mm with a displacement resolution of 0.25 μm and a repeatability of 1.0 μm.

In addition to tracking the movement of the lifting shaft 30 by the automated control 80, the movement of the lifting shaft 30 is tracked by a mechanical counter 82 mounted on the side wall 44 of the housing 22. The counter 82 registers the movement of the lifting shaft 30 by being coupled to the worm gear assembly 28 through a coupling shaft 83. The coupling shaft 83 extends through an opening 85 in the lifting mechanism 24 and an opening 86 in the housing wall 44 to a gear box 87 also mounted on the side wall 44 of the housing 22. As the lifting shaft 30 moves up and down, an output shaft 88 on the gear box 87 rotates a chain 89 coupled between the shaft 88 and an input shaft 90 of the counter 82 to thereby actuate the counter 82 in response to the movement of the lifting shaft 30. The mechanical counter 82 serves as a back-up to the automated control 80 in the event that the automated control 80 malfunctions or otherwise does not track the location of the lifting shaft 30.

Figure 5A:
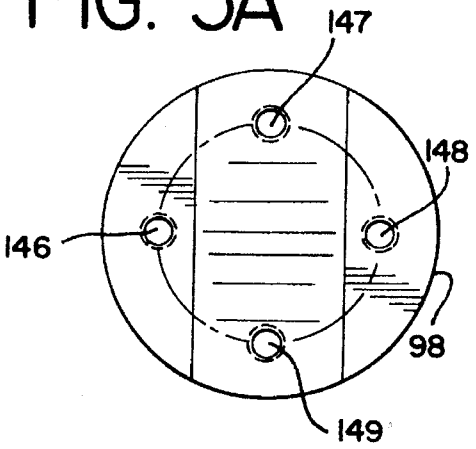
FIGS. 5A–5C are top, front and side elevational views of the other coupling component of an anti-binding connection used in the support platform assembly shown in FIG. 2.
Figure 3A:
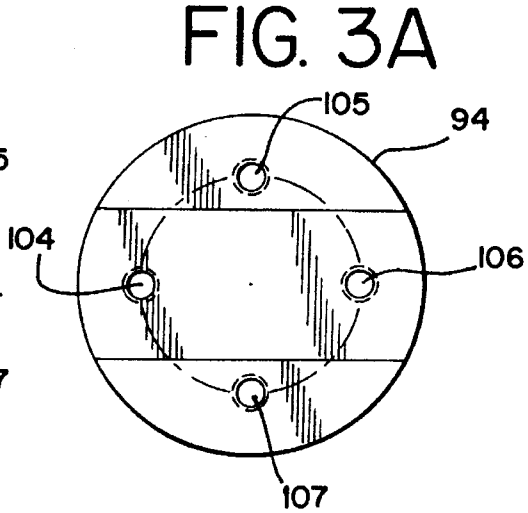
FIGS. 3A–3B are top and side elevational views of one of the coupling components of an anti-binding connection used in the support platform assembly shown in FIG. 2.
Figure 3B:
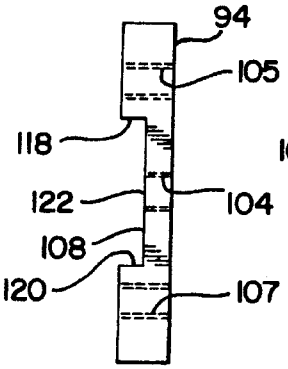

The raising and lowering of the lifting shaft 30 correspondingly raises and lowers the lifting mechanism 24 including the lifting platform 26 that is secured at a top end 91 of the lifting mechanism 24 by fasteners including fasteners 92 and 93 because the lifting shaft 30 is connected to the lifting platform 26 by the anti-binding connection 32. The anti-binding-connection 32 is designed so that the lifting shaft 30 will not be allowed to rotate with respect to the lifting platform 26 as it is being moved in the vertical direction, but is adapted to interface with the lifting platform 26 in a frictionless fashion to eliminate binding and wear due to tolerance mismatches. The anti-binding connection 32 includes an upper coupling member 94, an intermediate coupling member 96 and a lower coupling member 98. The upper coupling member 94 is seen in FIG. 2 and in more detail in FIGS. 3A–3B; the intermediate coupling member 96 is seen in FIG. 2 and in more detail in FIGS. 4A–4C; and the lower coupling member 98 is seen in FIG. 2 and in more detail in FIGS. 5A–5C.

Figure 4C:
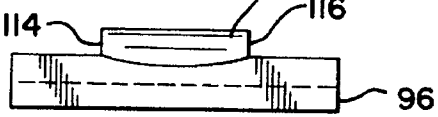
FIGS. 4A–4C are top, front and side elevational views of another one of the coupling components of an anti-binding connection used in the support platform assembly shown in FIG. 2.
Figure 4A:
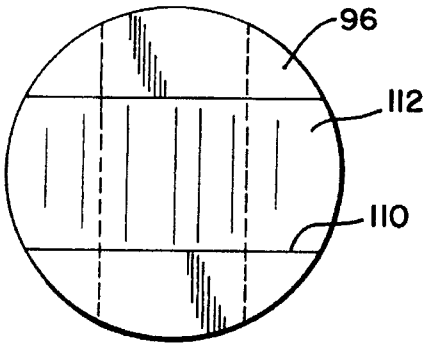
Figure 4B:
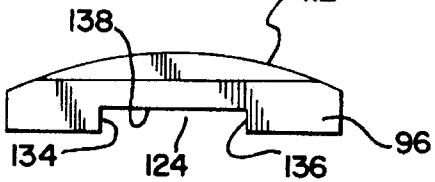

The upper coupling member 94 is secured to the lifting platform 26 by fasteners including fasteners 100–102 that extend through the lifting platform 26 and are threaded into corresponding holes 104–107 (FIG. 3A) in the upper coupling member 94. The upper coupling member 94 has a transversely extending slot or recess 108 that extends or faces downward as the upper coupling member 94 is viewed in FIG. 2. The recess 108 is adapted to receive a tab or projection 110 extending upwardly from the intermediate coupling member 96 as it is viewed in FIG. 2. As best seen in FIGS. 2, 4B and 4C, the tab 110 has a curved upper surface 112, but flat opposite side surfaces 114 and 116. When the tab 110 is positioned within the recess 108, the side surfaces 114 and 116 are lodged against flat side surfaces 118 and 120 of the recess 108 and the curved upper surface 112 is lodged against a top wall 122 of the recess 108. This intermeshing of the tab 110 in the recess 108 prevents the intermediate coupling member 96 from moving in a direction transverse to the axis of the shaft 30 (i.e., into and out of the plane of FIG. 2). However, the intermediate coupling member 96 is permitted to cant or sway with respect to the axis of the shaft 30 (i.e., in a left or a right direction in FIG. 2) due to the contacting of the curved surface 112 with the top wall 122 in the recess 108.

Figure 5B:
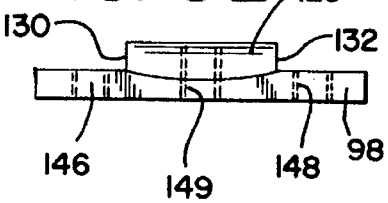
Figure 5C:
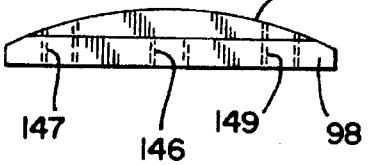

As best seen in FIG. 4B, the intermediate coupling member 96 also includes a lower, rectangular shaped recess 124. The recess 124 is adapted to receive therein a tab or projection 126 projecting upward from the lower coupling member 98. The tab 126 is similarly configured to the tab 110 in that it has a curved upper surface 128 (FIG. 5C), but flat opposite side surfaces 130 and 132 (FIG. 5B). When the tab 126 is positioned within the recess 124 in the intermediate coupling member 96, the side surfaces 130 and 132 are lodged against flat side surfaces 134 and 136 of the recess 124 and the curved upper surface 128 is lodged against a top wall 138 in the recess 124. This intermeshing of the tab 126 in the recess 124 prevents the lower coupling member 98 from moving in a direction transverse to the axis of the shaft 30 (i.e., in a left or a right direction in FIG. 2). However, the lower coupling member 98 is permitted to cant or sway with respect to the axis of the shaft 30 in a transverse direction.

The anti-binding connection 32 is secured to the shaft 30 by fasteners including fasteners 140–142 (FIG. 2) that extend through a shaft mounting block 144 secured to the top of the shaft 30 and are threaded into corresponding holes 146–149 (FIGS. 5A–5C) in the lower coupling member 98. As a result of having the anti-binding connection 32 interconnecting the shaft 30 to the platform 26, the shaft 30 will be prohibited from rotating, but will be allowed to cant or sway slightly with respect to the longitudinal axis of the shaft 30. As a result, the anti-binding connection 32 eliminates binding and wear of the shaft 30 due to possible tolerance mismatches.

It is additionally necessary to insure that the lifting mechanism 24 does not move in any horizontal direction as it is moving in the vertical direction to position the platform 26 at the desired height location. The lifting mechanism 24 is prevented from moving in a horizontal direction by the three linear roller bearing assemblies 34, 36, and 38. The roller bearing assembly 34 includes roller bearings 150 on a plate 152 that is located in a notch 154 in an outer wall 156 of the lifting mechanism 24 by fasteners including fasteners 158–159. The roller bearings 150 are pressed against a retaining block 160 that is secured to the outer wall 40 of the housing 22 by fasteners including fastener 162. Similarly, the roller bearing assembly 36 includes roller bearings 164 on a plate 166 that is located in a notch 168 in the outer wall 156 of the lifting mechanism 24 by fasteners including fasteners 170–171. The roller bearings 164 are pressed against a retaining block 172 that is secured to the outer wall 44 of the housing 22 by fasteners including fastener 174. The third roller bearing assembly 38 also includes roller bearings 176 that are on a plate 178 located in a notch 180 in the outer wall 156 of the lifting mechanism 24 by fasteners including fasteners 182–183. The roller bearings 176 are pressed against a retaining block 184 that is mounted in the wall 42 of the outer housing 22. The retaining block 184 can be moved towards or away from the center of the housing 22 by an adjustable mounting screw mechanism 186 extending through the outer wall 42. The screw mechanism 186 is adjusted so that the retaining block 184 exerts a preloading force against the roller bearings 176 resulting in all of the roller bearings 150, 164 and 176 being preloaded to insure that the lifting mechanism 24 will not move in the horizontal direction. Such preloading of the roller bearings 150, 164, and 176 enables the lifting mechanism 24 to be exclusively moved in the vertical direction without the necessity of complicated and expensive guideways.

Figure 6:
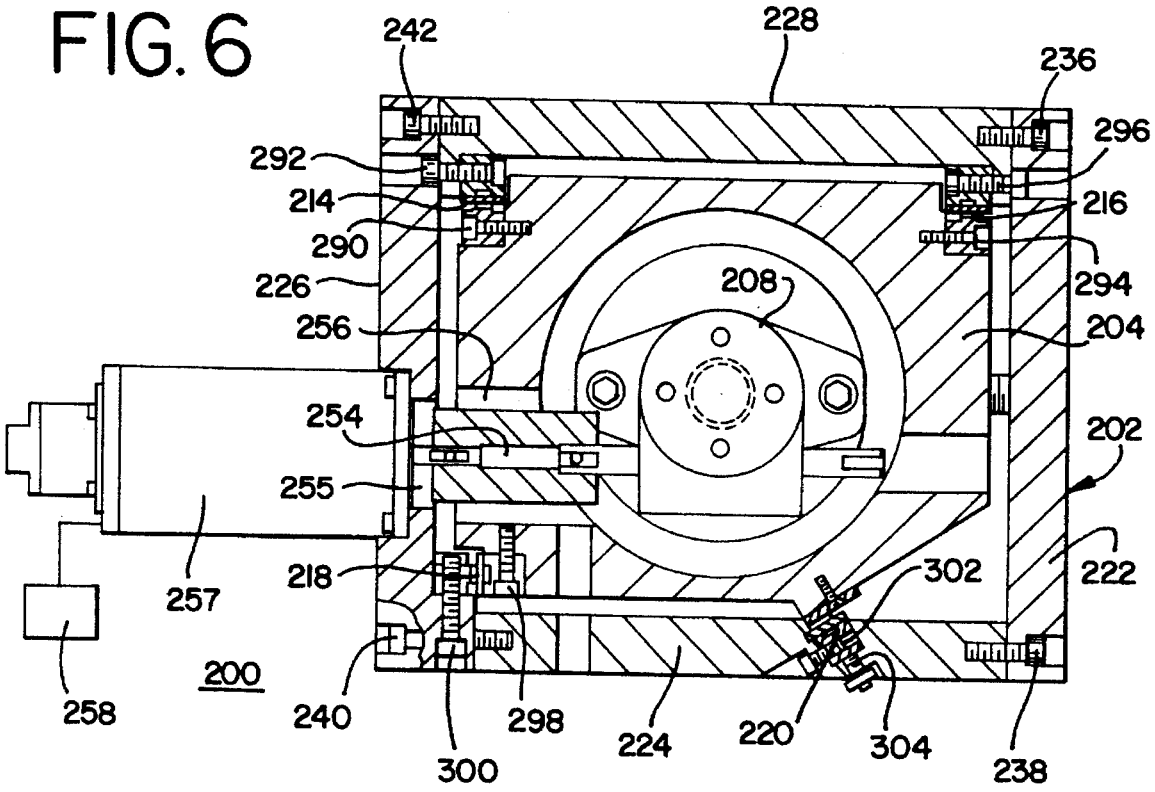
FIG. 6 is top cross-sectional view of an alternate embodiment of a support platform assembly which embodies the present invention.

As previously indicated, the support platform assembly 20 can be used to position loads of up to at least 4000N. In some cases, the loads being positioned in the beam line of the synchrotron are less in weight. In such cases, an alternate embodiment of a support platform assembly embodying the present invention can be used. One such alternate embodiment of a support platform assembly is disclosed in FIGS. 6–7 and is generally designated by the reference numeral 200. The support platform assembly 200 includes an outer housing 202 in which is disposed a lifting mechanism 204 having a lifting platform or stage 206 at its upper extremity. A worm gear assembly 208 located in the housing 202 raises and lowers a lifting shaft 210 that is fixed to the lifting platform 206 by an anti-binding connection 212. As a result, the lifting platform 206 is raised and lowered as the lifting shaft 210 is moved up and down. The anti-binding connection 212 prevents the shaft 210 from rotating with respect to the platform 206, but is nevertheless flexible in the vertical and horizontal directions so as to permit slight canting of the lifting platform 206 to eliminate binding and wear due to possible tolerance mismatches. Four linear roller bearing assemblies 214, 216, 218, and 220 are located around the outer periphery of the lifting mechanism 204. The roller bearing assemblies 214, 216, 218 and 220 ensure that the lifting mechanism 204 does not move in a horizontal direction as it travels vertically.

The outer housing 202 is formed by vertical side walls 222, 224, 226, and 228 and a base member 230. The side walls 222, 224, 226, and 228 are secured to the base member 230 by fasteners including fasteners 232 and 234 (shown in FIG. 7) whereas the side walls 222, 224, 226, and 228 are secured by fasteners including fasteners 236, 238, 240, and 242 (shown in FIG. 6) to each other to form the housing 202. The housing 202 is adapted to house the worm gear assembly 208 with the lifting platform 206 moveable in the vertical direction as the support lifting assembly 200 is viewed in FIG. 7.

The worm gear assembly 208 is secured by fasteners including fasteners 244 and 246 to a worm gear mounting block 248 that is secured to the base member 230 by fasteners including fasteners 250 and 252. The worm gear assembly 208 includes the lifting shaft 210 that is to be raised and lowered in response to the rotation of a worm gear input shaft 254. The shaft 254 extends through an opening 255 in the side wall 226 and an opening 256 in the lifting mechanism 204 from a worm gear stepper motor 257 mounted on the side wall 226 on the outside of the housing 202. When the worm gear motor 257 is energized, a nut (not shown) in the worm gear assembly 208 will rotate about a threaded end of the lifting shaft 210 to thereby cause the lifting shaft 210 to be raised or lowered depending on the direction that the nut is rotated within the worm gear assembly 208. As a result, the lifting shaft 210 is raised or lowered, but is not rotated. The amount that the lifting shaft 210 is moved is dependent on the energization of the worm gear stepper motor 257 under the control of an automated control 258.

The raising and lowering of the lifting shaft 210 correspondingly raises and lowers the lifting mechanism 204 including the lifting platform 206 that is secured on a top end 259 of the lifting mechanism 204 by fasteners including fasteners 260–261 (FIG. 7) because the lifting shaft 210 is connected to the lifting platform 206 by the anti-binding connection 212. The anti-binding connection 212 is designed so that the lifting shaft 210 will not be allowed to rotate as it is being moved in the vertical direction, but is adapted to interface with the lifting platform 206 in a frictionless fashion to eliminate binding and wear due to tolerance mismatches. The anti-binding connection 212 is more fully disclosed in FIGS. 8A–8C of the drawings.

Figure 7:
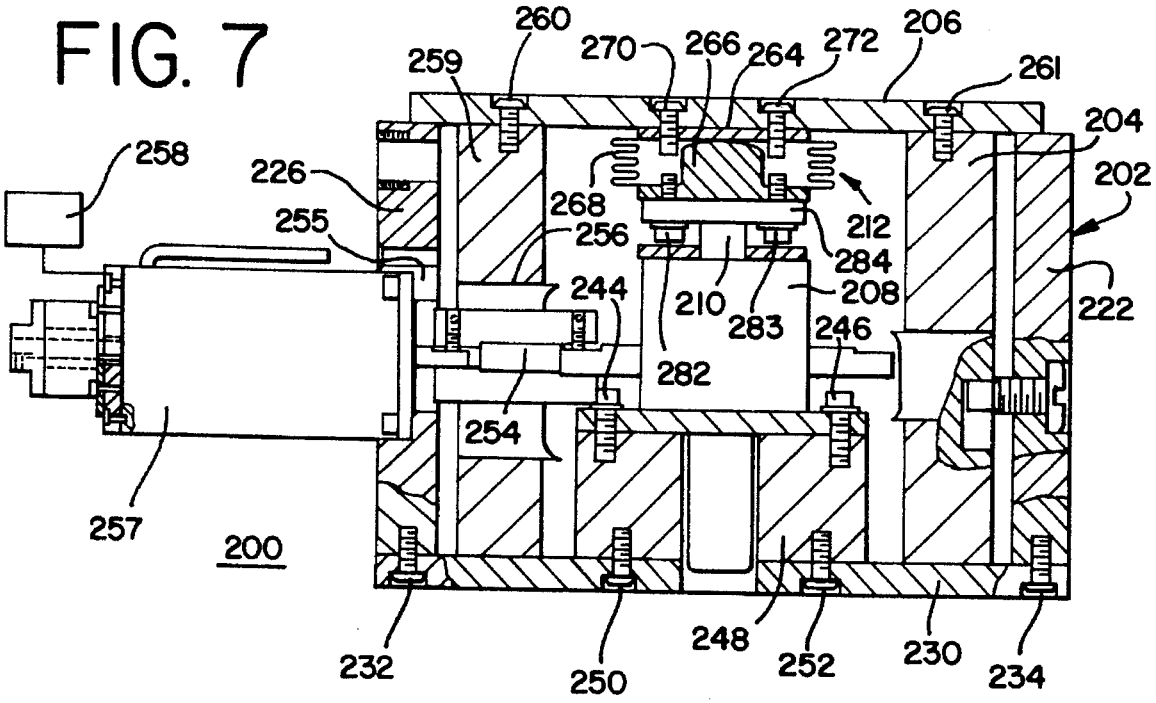
FIG. 7 is a side cross-sectional view of the support platform assembly shown in FIG. 6.

The anti-binding connection 212 includes an upper disk shaped coupling member 264 that is secured to a lower top hat shaped coupling member 266 by a barrel spring mechanism 268. The upper coupling member 264 is secured to the lifting platform 206 by fasteners including fasteners 270 and 272 (FIG. 7) that extend through the lifting platform 206 and are threaded into corresponding holes 274–277 (FIG. 8A) in the upper coupling member 264. As best seen in FIGS. 7, 8B and 8C, a curved upper surface 278 is formed at the upper extremity of the top hat shaped lower coupling member 266. The curved upper surface 278 is lodged against a lower surface 280 of the upper coupling member 264 and is maintained there by the barrel spring 268.

The lower coupling member 266 of the anti-binding connection 212 is secured to the shaft 210 by fasteners including fasteners 282–283 (FIG. 7) that extend through a shaft mounting block 284 secured to the top of the shaft 212 and are threaded into corresponding holes 286–289 (FIGS. 8B–8C) in the lower coupling member 266. As a result of having the anti-binding connection 212 interconnecting the shaft 210 to the platform 206, the shaft 210 will not be permitted to rotate with respect to the platform 206, but the spring mechanism 268 makes the connection between the upper coupling member 264 and the lower coupling member 266 sufficiently flexible in the horizontal and vertical directions that the upper coupling member 264 can cant slightly with respect to the longitudinal axis of the shaft 210. Consequently, the anti-binding connection 212 eliminates binding and wear of the shaft 210 due to possible tolerance mismatches.

It is additionally necessary to ensure that the lifting mechanism 204 does not move in any horizontal direction as it is moving in the vertical direction to position the platform 206 at its proper height location. The lifting mechanism 204 is prevented from moving in a horizontal direction by the four linear roller bearing assemblies 214, 216, 218 and 220. The roller bearing assembly 214 is secured to the lifting mechanism 204 by fasteners including fastener 290 and to the outer housing wall 226 by fasteners including fastener 292. Similarly, the roller bearing assembly 216 is secured to the lifting mechanism 204 by fasteners including fastener 294 and to the outer housing wall 222 by fasteners including fastener 296. The third roller bearing assembly 218 also is secured to the lifting mechanism 204 and to the outer wall 224 of the housing 202. Fasteners including fastener 298 secure the roller bearing assembly 218 to the lifting mechanism 204 and fasteners including fastener 300 secure the roller bearing assembly 218 to the outer wall 224. The last roller bearing assembly 220 is secured to the lifting mechanism 204 and to the outer housing wall 224 by fasteners including fastener 302. An adjusting mechanism including adjusting fastener 304 is included in the roller bearing assembly 220. By adjusting the fastener 304, a preloading force can be applied to the roller bearing assemblies 214, 216, 218 and 220 so that the roller bearings are preloaded to ensure that the lifting mechanism 204 will not move in the horizontal direction. This preloading of the roller bearing assemblies 214, 216, 218 and 220 restricts the movement of the lifting mechanism 204 to only a vertical movement without the necessity of complicated and expensive guideways.

Figure 9:
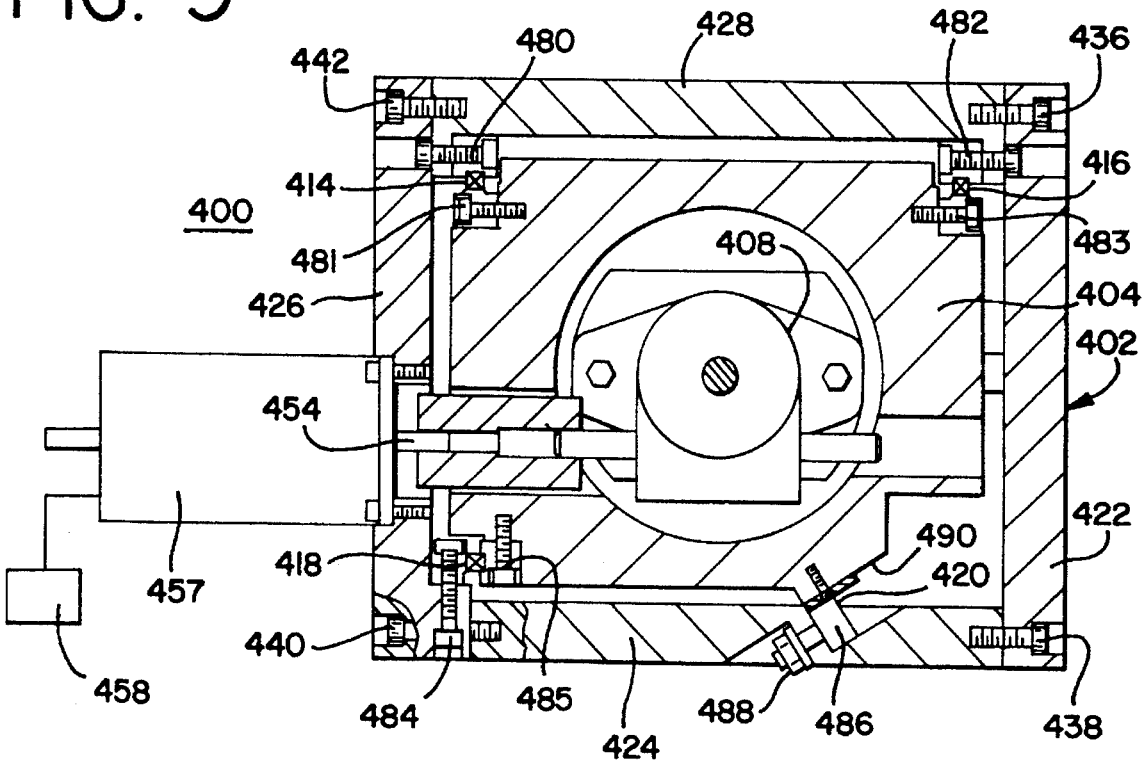
FIG. 9 is top cross-sectional view of another alternate embodiment of a support platform assembly for a synchrotron which assembly embodies the present invention.
Figure 10:
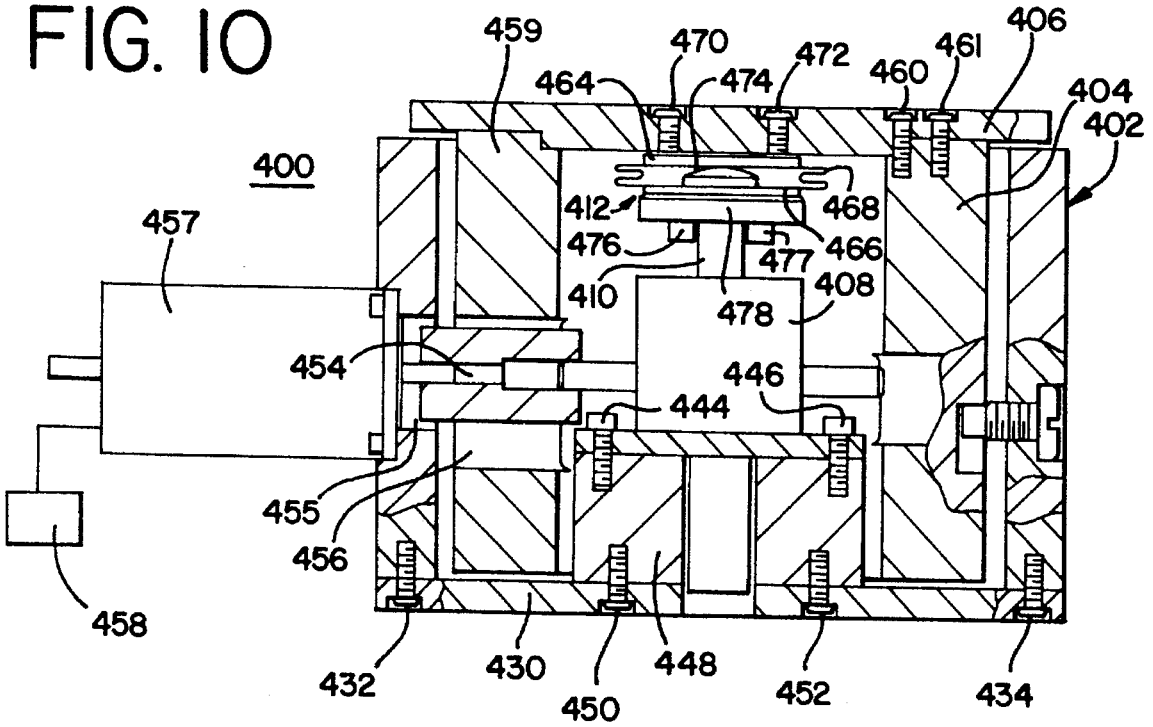
FIG. 10 is a side cross-sectional view of the support platform assembly shown in FIG. 9.

Another alternate embodiment of a support platform assembly embodying the present invention is disclosed in FIGS. 9–10 and is generally designated by the reference numeral 400. The support platform assembly 400 is similar in many respects to the support platform assembly 200 and like the support platform assembly 200 can be used in those cases where extremely heavy loads are not being positioned in the beam line of the synchrotron.

The support platform assembly 400 includes an outer housing 402 in which is disposed a lifting mechanism 404 having a lifting platform or stage 406 at its upper extremity. A worm gear assembly 408 located in the housing 402 raises and lowers a lifting shaft 410 that is fixed to the lifting platform 406 by an anti-binding connection 412. As a result, the lifting platform 406 is raised and lowered as the lifting shaft 410 is moved up and down. The anti-binding connection 412 prevents the shaft 410 from rotating with respect to the platform 406, but is nevertheless flexible in the vertical and horizontal directions so as to permit slight canting of the lifting platform 406 to eliminate binding and wear due to possible tolerance mismatches. Three linear roller bearing assemblies 414, 416, and 418 are located around the outer periphery of the lifting mechanism 404. The roller bearing assemblies 414, 416, and 418 ensure that the lifting mechanism 404 does not move in a horizontal direction as it travels vertically. In order to preload the roller bearing assemblies 414, 416, and 418, a preloading cam mechanism 420 also is located on the outer periphery of the lifting mechanism 404.

The outer housing 402 is formed by vertical side walls 422, 424, 426, and 428 and a base member 430. The side walls 422, 424, 426, and 428 are secured to the base member 430 by fasteners including fasteners 432 and 434 (shown in FIG. 10), whereas the side walls 422, 424, 426, and 428 are secured by fasteners including fasteners 436, 438, 440, and 442 (shown in FIG. 9) to each other to form the housing 402. The housing 402 is adapted to house the worm gear assembly 408 with the lifting platform 406 moveable in the vertical direction as the support lifting assembly 400 is viewed in FIG. 10.

The worm gear assembly 408 is secured by fasteners including fasteners 444 and 446 to a worm gear mounting block 448 that is secured to the base member 430 by fasteners including fasteners 450 and 452. The worm gear assembly 408 includes the lifting shaft 410 that is to be raised and lowered in response to the rotation of a worm gear input shaft 454. The shaft 454 extends through an opening 455 in the side wall 426 and an opening 456 in the lifting mechanism 404 from a worm gear stepper motor 457 mounted on the side wall 426 on the outside of the housing 402. When the worm gear motor 457 is energized, a nut (not shown) in the worm gear assembly 408 will rotate about a threaded end of the lifting shaft 410 to thereby cause the lifting shaft 410 to be raised or lowered depending on the direction that the nut is rotated within the worm gear assembly 408. As a result, the lifting shaft 410 is raised or lowered, but is not rotated. The amount that the lifting shaft 410 is moved is dependent on the energization of the worm gear stepper motor 457 under the control of an automated control 458.

The raising and lowering of the lifting shaft 410 correspondingly raises and lowers the lifting mechanism 404 including the lifting platform 406 that is secured on a top end 459 of the lifting mechanism 404 by fasteners including fasteners 460–461 (FIG. 10), because the lifting shaft 410 is connected to the lifting platform 406 by the anti-binding connection 412. The anti-binding connection 412 is designed so that the lifting shaft 410 will not be allowed to rotate as it is being moved in the vertical direction, but is adapted to interface with the lifting platform 406 in a frictionless fashion to eliminate binding and wear due to tolerance mismatches. The anti-binding connection 412 is similar to the anti-binding connection 212 that is disclosed in FIGS. 8A–8C of the drawings.

The anti-binding connection 412 includes an upper disk shaped coupling member 464 that is secured to a lower top hat shaped coupling member 466 by a barrel spring mechanism 468. The upper coupling member 464 is secured to the lifting platform 406 by fasteners including fasteners 470 and 472 (FIG. 10), that extend through the lifting platform 406 and are threaded into the upper coupling member 464. As is shown in FIG. 10, a curved upper surface 474 is formed at the upper extremity of the top hat shaped lower coupling member 466. The curved upper surface 474 is lodged against the upper coupling member 464 and is maintained there by the barrel spring 468.

The lower coupling member 466 of the anti-binding connection 412 is secured to the shaft 410 by fasteners including fasteners 476–477 (FIG. 10) that extend through a shaft mounting block 478 secured to the top of the shaft 412 and into the lower coupling member 466. As a result of having the anti-binding connection 412 interconnecting the shaft 410 to the platform 406, the shaft 410 will not be permitted to rotate with respect to the platform 406, but the spring mechanism 468 makes the connection between the upper coupling member 464 and the lower coupling member 466 sufficiently flexible in the horizontal and vertical directions that the upper coupling member 464 can cant slightly with respect to the longitudinal axis of the shaft 410. Consequently, the anti-binding connection 412 eliminates binding and wear of the shaft 410 due to possible tolerance mismatches.

It is additionally necessary to ensure that the lifting mechanism 404 does not move in any horizontal direction as it is moving in the vertical direction to position the platform 406 at its proper height location. The lifting mechanism 404 is prevented from moving in a horizontal direction by the three linear roller bearing assemblies 414, 416 and 418. The roller bearing assembly 414 is secured between the lifting mechanism 404 and the side wall 426 by fasteners including fasteners 480–481; the roller bearing assembly 416 is secured between the lifting mechanism 404 and the side wall 422 by fasteners including fasteners 482–483; and the third roller bearing assembly 418 is secured between the lifting mechanism 404 and the side wall 424 by fasteners including fasteners 484–485. An appropriate preloading force is applied to the roller bearing assemblies 414, 416 and 418 by the preloading cam mechanism 420. The preloading cam mechanism 420 has eccentric cams including eccentric cam 486 that are positioned between the side wall 424 and an outer angled edge 490 of the lifting mechanism 404. These cams 486 can be adjusted by adjusting fasteners such as fastener 488 so that the roller bearings in the roller bearing assemblies 414, 416, and 418 are preloaded to ensure that the lifting mechanism 404 will not move in the horizontal direction. This preloading of the roller bearing assemblies 414, 416 and 418 restricts the movement of the lifting mechanism 404 to only a vertical movement without the necessity of complicated and expensive guideways.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A support platform assembly for positioning equipment comprising:

a housing;

a support platform on which is supported said equipment and which is adapted to be moved in a vertical direction, said support platform defining a support plane;

a lifting means disposed in said housing for moving said support platform in said vertical direction to thereby position said equipment, said lifting means including a lifting shaft having a shaft axis extendinq along said shaft and a shaft lifting means that is adapted to move said lifting shaft in a vertical direction without rotating said lifting shaft; and an anti-binding connection means for connecting said lifting shaft to said support platform, said anti-binding connection means preventing said lifting shaft from rotating with respect to said support platform while permitting said axis of said lifting shaft to cant slightly with respect to said support plane of said support platform.

2. A support platform assembly as set forth in claim 1 including bearing means for bearing against said lifting means so as to prevent said lifting means from moving in a horizontal direction as said shaft lifting means moves said lifting shaft in said vertical direction.

3. A support platform assembly for positioning equipment comprising:

a housing;

a support platform on which is supported said equipment and which is adapted to be moved in a vertical direction;

a lifting means disposed in said housing for moving said support platform in said vertical direction to thereby position said equipment, said lifting means including a lifting shaft and a shaft lifting means that is adapted to move said lifting shaft in a vertical direction without rotating said lifting shaft;

an anti-binding connection for connecting said lifting shaft to said support platforms, said anti-binding connection preventing said lifting shaft from rotating with respect to said support platform while permitting said lifting shaft to cant slightly with respect to said support platform; and bearing means for bearing against said lifting means so as to prevent said lifting means from moving in a horizontal direction as said shaft lifting means moves said lifting shaft in said vertical direction, said bearing means including at least three linear roller bearing assemblies arranged around the outer-periphery of said lifting means, one of said linear roller bearing assemblies being adjustable so that said roller bearing assemblies apply a loading force against said lifting means.

4. A support platform assembly for positioning equipment comprising:

a housing;

a support platform on which is supported said equipment and which is adapted to be moved in a vertical direction;

a lifting means disposed in said housing for moving said support platform in said vertical direction to thereby position said equipment, said lifting means including a lifting shaft and a shaft lifting means that is adapted to move said lifting shaft in a vertical direction without rotating said lifting shaft;

an anti-binding connection for connecting said lifting shaft to said support platform, said anti-binding connection preventing said lifting shaft from rotating with respect to said support platform while permitting said lifting shaft to cant slightly with respect to said support platform; and bearing means for bearing against said lifting means so as to prevent said lifting means from moving in a horizontal direction as said shaft lifting means moves said lifting shaft in said vertical direction, said bearing means including a plurality of linear roller bearing assemblies arranged around the outer-periphery of said lifting means and cam means for providing a loading force that results in said roller bearing assemblies applying a loading force against said lifting means.

5. A support platform assembly as set forth in claim 1 including a control means for controlling the operation of said shaft lifting means to move said lifting shaft in said vertical direction.

6. A support platform assembly as set forth in claim 1 wherein said shaft lifting means includes a worm gear motor disposed externally of said housing and includes a worm gear means disposed within said housing for moving said lifting shaft in said vertical direction, said worm gear motor being connected to said worm gear means by a rotatable worm gear shaft extending through said housing and said lifting means.

7. A support platform assembly as set forth in claim 6 wherein said housing includes a first opening and said lifting means includes a second opening through which first and second openings said worm gear shaft extends.

8. A support platform assembly as set forth in claim 1 including a mechanical counter means for determining the location of said platform as said lifting means moves said lifting shaft and thereby said platform in said vertical direction.

9. A support platform assembly for positioning equipment comprising:

a housing;

a support platform on which is supported said equipment and which is adapted to be moved in a vertical direction;

a lifting means disposed in said housing for moving said support platform in said vertical direction to thereby position said equipment, said lifting means including a lifting shaft and a shaft lifting means that is adapted to move said lifting shaft in a vertical direction without rotating said lifting shaft; and an anti-binding connection for connecting said lifting shaft to said support platform, said anti-binding connection preventing said lifting shaft from rotating with respect to said support platform while permitting said lifting shaft to cant slightly with respect to said support platform; said anti-binding connection including a first coupling means affixed to said platform, a second coupling means affixed to said lifting shaft and a third coupling means disposed between said first and second coupling means.

10. A support platform assembly as set forth in claim 9 wherein said first coupling means includes a first recess into which a first curved surface of a first tab on said third coupling means is disposed and said third coupling means includes a second recess into which a second curved surface of a second tab on said second coupling is disposed.

11. A support platform assembly as set forth in claim 10 wherein said first tab has first tab side surfaces that mate with first recess side surfaces of said first recess and said second tab has second tab side surfaces that mate with second recess side surfaces of said second recess.

12. A support platform assembly as set forth in claim 10 wherein said first and second tabs are orthogonally disposed with respect to each other and said first and second recesses are orthogonally disposed with respect to each other.

13. A support platform assembly as set forth in claim 1 wherein said shaft lifting means is disposed off-center of the center of said housing.

14. A support platform assembly for positioning equipment comprising:

a housing;

a support platform on which is supported said equipment and which is adapted to be moved in a vertical direction;

a lifting means disposed in said housing for moving said support platform in said vertical direction to thereby position said equipment, said lifting means including a lifting shaft and a shaft lifting means that is adapted to move said lifting shaft in a vertical direction without rotating said lifting shaft; and an anti-binding connection for connecting said lifting shaft to said support platform, said anti-binding connection preventing said lifting shaft from rotating with respect to said support platform while permitting said lifting shaft to cant slightly with respect to said support platform; said anti-binding connection including a first coupling means affixed to said platform and a second coupling means affixed to said lifting shaft, said second coupling means having a curved surface that engages said first coupling means, and spring means interconnecting said first and second coupling means.

15. An anti-binding connection for use in interconnecting a lifting shaft that is adapted to move in a vertical direction to a support platform in a support platform assembly used to position equipment mounted on said platform, said anti-binding connection comprising:

a first coupling means affixed to said platform, said first coupling means having a first recess extending in a first direction;

a second coupling means affixed to said lifting shaft and having a first tab with a first curved surface; and a third coupling means disposed between said first and second coupling means, said third coupling means having a second tab with a second curved surface disposed in said first recess and having a second recess extending in a second direction transverse to said first direction, said first tab extending from said second coupling means and being disposed in said second recess such that said anti-binding connection prevents said lifting shaft from rotating with respect to said support platform while permitting said lifting shaft to cant slightly with respect to said support platform.

16. An anti-binding connection as set forth in claim 15 wherein said second tab has first tab side surfaces that mate with first recess side surfaces of said first recess so that said first and third coupling means are prevented from rotating with respect to each other and said first tab has second tab side surfaces that mate with second recess side surfaces of said second recess so that said second and third coupling means are prevented from rotating with respect to each other.

17. An anti-binding connection for use in interconnecting a lifting shaft that is adapted to move in a vertical direction to a support platform in a support platform assembly used to position equipment mounted on said platform, said anti-binding connection comprising:

a first coupling means affixed to said platform;

a second coupling means affixed to said lifting shaft and having a curved surface; and a spring means disposed between said first and second coupling means and securing said first coupling means to said second coupling means such that said curved surface engages said first coupling means so that said first and second coupling means are prevented from rotating with respect to each other while permitting said lifting shaft to cant with respect to said platform.

* * * * *